US006467200B1

(12) United States Patent
Satzler

(10) Patent No.: US 6,467,200 B1
(45) Date of Patent: Oct. 22, 2002

(54) SHOE MECHANISM FOR AN EXCAVATING WHEEL AND ASSOCIATED METHOD

(75) Inventor: Ronnie L. Satzler, Princeville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/529,694

(22) PCT Filed: Mar. 20, 2000

(86) PCT No.: PCT/US00/07382

§ 371 (c)(1),
(2), (4) Date: Apr. 18, 2000

(87) PCT Pub. No.: WO01/71108

PCT Pub. Date: Sep. 27, 2001

(51) Int. Cl.[7] ..... E02F 3/08
(52) U.S. Cl. ..... 37/337; 37/189; 37/195
(58) Field of Search ..... 37/337, 338, 339, 37/352, 307, 308, 309, 901, 418, 195, 189, 190

(56) References Cited

U.S. PATENT DOCUMENTS

| | | | | |
|---|---|---|---|---|
| 4,197,036 | A | * | 4/1980 | Masquelier |
| 4,267,652 | A | | 5/1981 | Senesac |
| 4,301,606 | A | | 11/1981 | Hofmeester |
| 4,397,106 | A | * | 8/1983 | MdDowell |
| 4,430,812 | A | * | 2/1984 | Van der Ent |
| 4,887,371 | A | | 12/1989 | Kaiser |
| 5,170,576 | A | | 12/1992 | Steinkuhler et al. |
| 5,903,989 | A | | 5/1999 | Satzler |
| 5,907,915 | A | | 6/1999 | Satzler |
| 5,960,570 | A | | 10/1999 | Satzler |
| 6,022,173 | A | * | 2/2000 | Saxon |
| 6,357,149 | B1 | * | 3/2002 | Satzler |

FOREIGN PATENT DOCUMENTS

| | | | | |
|---|---|---|---|---|
| JP | 358150633 A | * | 9/1983 | ..... 37/337 |
| JP | 360138126 A | * | 7/1985 | ..... 37/337 |

* cited by examiner

*Primary Examiner*—Victor Batson
(74) *Attorney, Agent, or Firm*—Blackwell Sanders Peper Martin LLP

(57) ABSTRACT

A shoe mechanism adapted for use on a dredging apparatus (10) to remove silt from under the surface of a body of water and associated method, the dredging apparatus being operative in both a forward and reverse direction of travel and including an excavating wheel assembly (16), the shoe mechanism including a pair of outer shoe assemblies (18) pivotally connected to the wheel frame assembly (24), one of the shoe assemblies being located adjacent a portion of the wheel assembly (16) on the leading side thereof and one of the shoe assemblies being located adjacent a portion of the wheel assembly (16) on the trailing side thereof, each of the outer shoe assemblies (18) being pivotally movable between an operative position wherein the shoe assembly is positioned adjacent the outermost circumference (28) of the wheel assembly (16) between the silt bed and a point above the water level, and a retracted position wherein the shoe assembly is spaced from the outermost circumference (28) of the wheel assembly (16), one of the outer shoe assemblies being positioned in its operative position and the other shoe assembly being positioned in its retracted position during a dredging operation. Each outer shoe assembly may likewise include a latching mechanism (88,94,100) for holding the shoe assembly in its operative position and a release mechanism (54,56,62,64) operative to permit the shoe assembly to pivot a sufficient distance away from the excavating wheel assembly (16) when in its operative position in the event that a foreign object becomes trapped between the excavating wheel assembly (16) and the shoe assembly (18).

28 Claims, 7 Drawing Sheets

SHOE MECHANISM FOR AN EXCAVATING WHEEL AND ASSOCIATED METHOD

TECHNICAL FIELD

This invention relates generally to a shoe or shoe mechanism utilized with an excavating wheel and associated method and, more particularly, to a pair of outer shoe/shield assemblies operatively positioned in association with the excavating wheel of a dredging apparatus for removing silt from the bottom of a body of water, the dredging apparatus being operable in both a forward and a reverse direction of travel.

BACKGROUND ART

Various types of dredging apparatus are well known in the art for removing silt, sand, mud or other sediment from the bottom of a body of water. One such dredging apparatus is disclosed in U.S. Pat. No. 5,960,570 and includes a floatation arrangement operative to float on the surface of the body of water, a frame structure mounted on the floatation arrangement, and a silt excavating wheel mechanism rotatably mounted to the frame structure and operative to extract silt from under the body of water. Such apparatus also typically includes a height adjustment mechanism operative to raise and lower the excavating wheel mechanism relative to the surface of the water and may include a conveyor arrangement operative to transport the extracted silt away from the excavating wheel mechanism.

Typically, the dredging apparatus and its associated excavating wheel are designed and constructed such that the dredging operation takes place in one predetermined direction such as in the forward direction of travel of the dredging apparatus. As a result, only a portion of the excavating wheel assembly must be shielded from the volume of water on the trailing side thereof between the silt located under the body of water and a point located above the water level. Since dredging only occurs in one direction, the known shoe or shield mechanisms such as the shield mechanism disclosed in U.S. Pat. No. 5,960,570 are always positioned and located adjacent the wheel assembly in an operative position and such known shoe mechanisms are not movable to an inoperative or retracted position. A retracted position is advantageous when the dredging apparatus is being maneuvered to and from the dredging location so as to avoid excessive wear and tear and/or damage to both the shoe and wheel mechanisms In addition, the forward or leading side of known excavating wheel assemblies do not include a shoe or shield mechanism thereby preventing dredging in the reverse direction.

Accordingly, the present invention is directed to overcoming one or more of the problems as set forth above.

DISCLOSURE OF THE INVENTION

In one aspect of the present invention, a shoe mechanism adapted for use on a dredging apparatus to remove silt from under the surface of a body of water, the dredging apparatus being operative in a forward and reverse direction and including an excavating wheel assembly, the excavating wheel assembly having an innermost and an outermost circumference, top and bottom portions, and a plurality of silt retaining chambers, the excavating wheel assembly being rotatably mounted on a wheel frame assembly to define a leading side and a trailing side of the wheel assembly when the apparatus is operative in its forward or reverse direction is disclosed. The shoe mechanism includes a pair of outer shoe assemblies pivotally connected to the wheel frame assembly, one of said shoe assemblies being located adjacent a portion of the excavating wheel assembly on the leading side thereof and one of said shoe assemblies being located adjacent a portion of the excavating wheel assembly on the trailing side thereof, each of said outer shoe assemblies being pivotally movable between an operative position wherein said shoe assembly is positioned adjacent the outermost circumference of the wheel assembly between the silt under the body of water and a point above the water level, and a retracted position wherein said shoe assembly is positioned in spaced apart relationship from the outermost circumference of the wheel assembly, one of said outer shoe assemblies being positioned in its operative position and the other of said outer shoe assemblies being positioned in its retracted position when the dredging apparatus is removing silt from under the surface of a body of water.

In another aspect of the present invention, a method for removing silt from under the surface of a body of water using a dredging apparatus operative in both a forward and reverse direction, the dredging apparatus including an excavating wheel assembly having an innermost and an outermost circumference and a plurality of silt retaining chambers, the excavating wheel assembly being rotatably mounted on a wheel frame assembly to define a leading side and a trailing side of the wheel assembly when the apparatus is operative in its forward or reverse direction is disclosed. The method includes the following steps: attaching a pair of outer shoe assemblies to the wheel frame assembly, one of said shoe assemblies being located adjacent a portion of the excavating wheel assembly on the leading side thereof and one of said shoe assemblies being located adjacent a portion of the excavating wheel assembly on the trailing side thereof; enabling each of said outer shoe assemblies to be pivotally movable relative to the wheel assembly, each of said outer shoe assemblies being pivotally movable between an operative position wherein said shoe assembly is positioned adjacent the outermost circumference of the wheel assembly between the silt under the body water and a point above the water level, and a retracted position wherein said shoe assembly is positioned in spaced apart relationship from the outermost circumference of the wheel assembly; determining the direction of travel of the dredging apparatus for a particular dredging operation; determining the leading side and trailing side of the wheel assembly based upon the direction of travel of the dredging apparatus for the particular dredging operation; positioning the shoe assembly disposed on the trailing side of the excavating wheel assembly in its operative position prior to commencing the particular dredging operation; and positioning the shoe assembly disposed on the leading side of the excavating wheel assembly in its retracted position prior to commencing the particular dredging operation.

BRIEF DESCRIPTION OF THE DRAWINGS

For a better understanding of the present invention, reference may be made to the accompanying drawings in which.

BEST MODE FOR CARRYING OUT THE INVENTION

Figure 1:
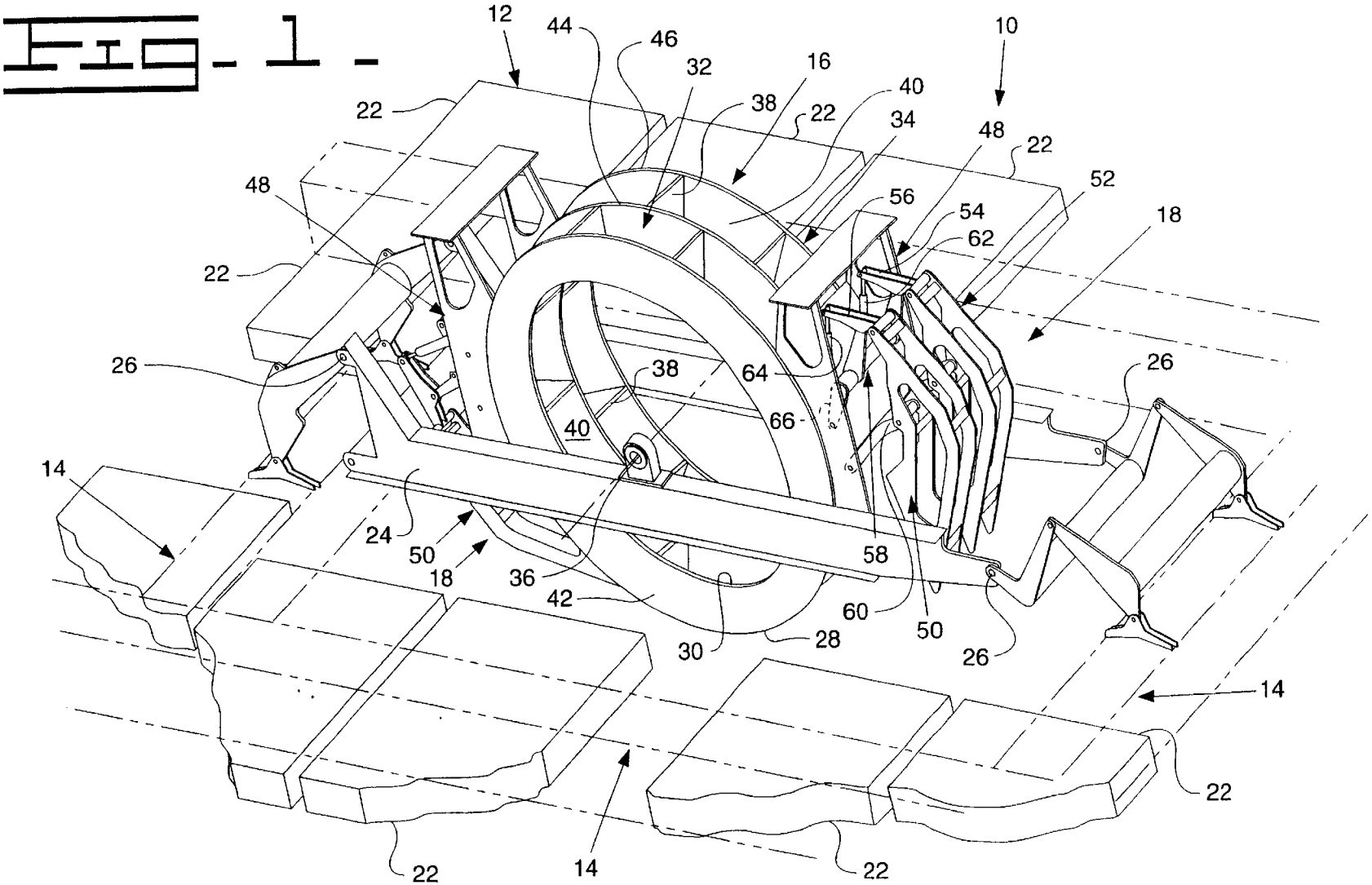
FIG. 1 is a partial prospective view of a typical dredging apparatus adapted to utilize the shoe/shield mechanisms of the present invention.

Referring to the drawings, numeral 10 in FIG. 1 discloses a portion of a dredging apparatus 10 which is adapted to remove silt from the bottom of a body of water, the apparatus 10 including a floatation arrangement 12, a base frame structure 14 connected to the floatation arrangement 12, a silt excavating wheel mechanism 16 operative to remove silt from underneath the body of water, a pair of shoe/shield mechanisms 18 operative to shoe the wheel mechanism 16 from the water during the time the silt is being removed from the bottom of the body of water depending upon the particular direction of travel of the apparatus 10, and an ejector mechanism 20 operative to aid in the removal of the silt from the wheel mechanism 16. Although not illustrated in FIG. 1, a typical dredging apparatus such as the apparatus 10 would also include a conveying system operative to transport the silt away from the wheel mechanism 16, a height adjustment mechanism operative to raise and lower the wheel mechanism 16 relative to the silt bed, and a propulsion and steering system for maneuvering the apparatus 10 on the body of water.

The floatation arrangement 12 includes a plurality of individual floats 22 interconnected to each other by the frame structure 14 to form a base platform. The floatation arrangement 12 also includes a buoyancy control arrangement operative to control the level of the platform by increasing or decreasing the buoyancy of at least certain ones of the plurality of floats 22 in order to compensate for changes in weight distribution.

The silt excavating wheel mechanism 16 includes a wheel frame assembly 24 pivotally connected to the frame structure 14 at a plurality of pivot points 26 and a height adjusting mechanism (not shown). The silt excavating wheel mechanism 16 has an outermost circumference 28, an innermost circumference 30, and includes first and second wheel assemblies 32 and 34 rotatably mounted to the wheel frame assembly 24 about an axis 36. The first and second wheel assemblies 32 and 34 may be secured or otherwise attached one to the other, or such assemblies may be made as one integral unit. It is also recognized that a single wheel assembly such as wheel assembly 32 or 34 could likewise be adapted for use with the dredging apparatus 10 without departing from the spirit and scope of the present invention. In similar fashion, although the axis 36 is illustrated as being parallel with the surface of the water, it is recognized and anticipated that other wheel axis configurations and arrangements may likewise be utilized. For example, it is recognized that the wheel mechanism 16 could be rotatably mounted to the base frame structure 14 and a different type of height adjustment control mechanism could be utilized.

Each of the first and second wheel assemblies 32 and 34 include a plurality of radially spaced vanes 38 that define respective silt retaining chambers 40. The vanes 38 are positioned between the opposed wheel side members 42, 44 and 46 as best illustrated in FIG. 1, the wheel side member 44 forming a divider wall between the first and second wheel assemblies 32 and 34. Each of the respective vanes 38 extends from the outermost circumference 28 of the respective wheel assemblies 32 and 34 to the innermost circumference 30 thereof. As illustrated, the vanes 38 associated with one wheel assembly 32 are radially offset from the vanes 38 associated with the other wheel assembly 34 as best illustrated in FIG. 1. It is recognized and anticipated that the vanes 38 associated with the respective wheel assemblies 32 and 34 do not have to be offset relative to each other. Similarly, although the vanes 38 are illustrated as being substantially straight, it is likewise recognized and anticipated that the vanes 38 could be curved or could include a continuing changing radius without departing from the spirit and scope of the present invention. Any curvature associated with the vanes 38 would permit the respective vanes to enter the silt so as not to create unnecessary turbulence between the silt and the water.

The wheel assemblies 32 and 34 are preferably driven by a electric motor assembly (not shown) in a conventional manner. However, a fluid motor could also be utilized to drive the Wheel assemblies 32 and 34. In addition, a typical dredging apparatus will likewise include a propulsion and steering system (not shown). These systems will normally include a pair of independent drive wheel assemblies or spade wheels which are utilized to both steer the dredging apparatus 10 as well as propel the apparatus in both a forward and a reverse direction. Each drive wheel assembly will normally include a fluid driven drive wheel, a linkage arrangement disposed between the fluid driven drive wheel and the frame structure of the dredging apparatus, a fluid actuated cylinder operative to raise and lower the drive wheel assembly, and a plurality of spade shaped members attached to the periphery of the drive wheel operative to penetrate the silt for traction. The propulsion and steering system is operative in a well known manner to propel and steer the dredging apparatus 10 and the associated linkage arrangement is likewise operative in a well known manner to maintain the respective drive wheels in a generally vertical orientation during raising and lowering. Also, the respective drive wheel assemblies are typically independently controlled and steering is achieved by turning one drive wheel faster or slower as compared to the other drive wheel.

A wide variety of different types of conveyor systems can likewise be utilized with the dredging apparatus 10 without departing from the spirit and scope of the present invention. An appropriate conveyor mechanism such as the conveyor system illustrated in U.S. Pat. No. 5,960,570 would be operatively located to receive the removed silt from the respective wheel assemblies 32 and 34 and thereafter transport and deposit such silt at an appropriate storage location such as onto a barge or some other transporting mechanism.

Figure 2:
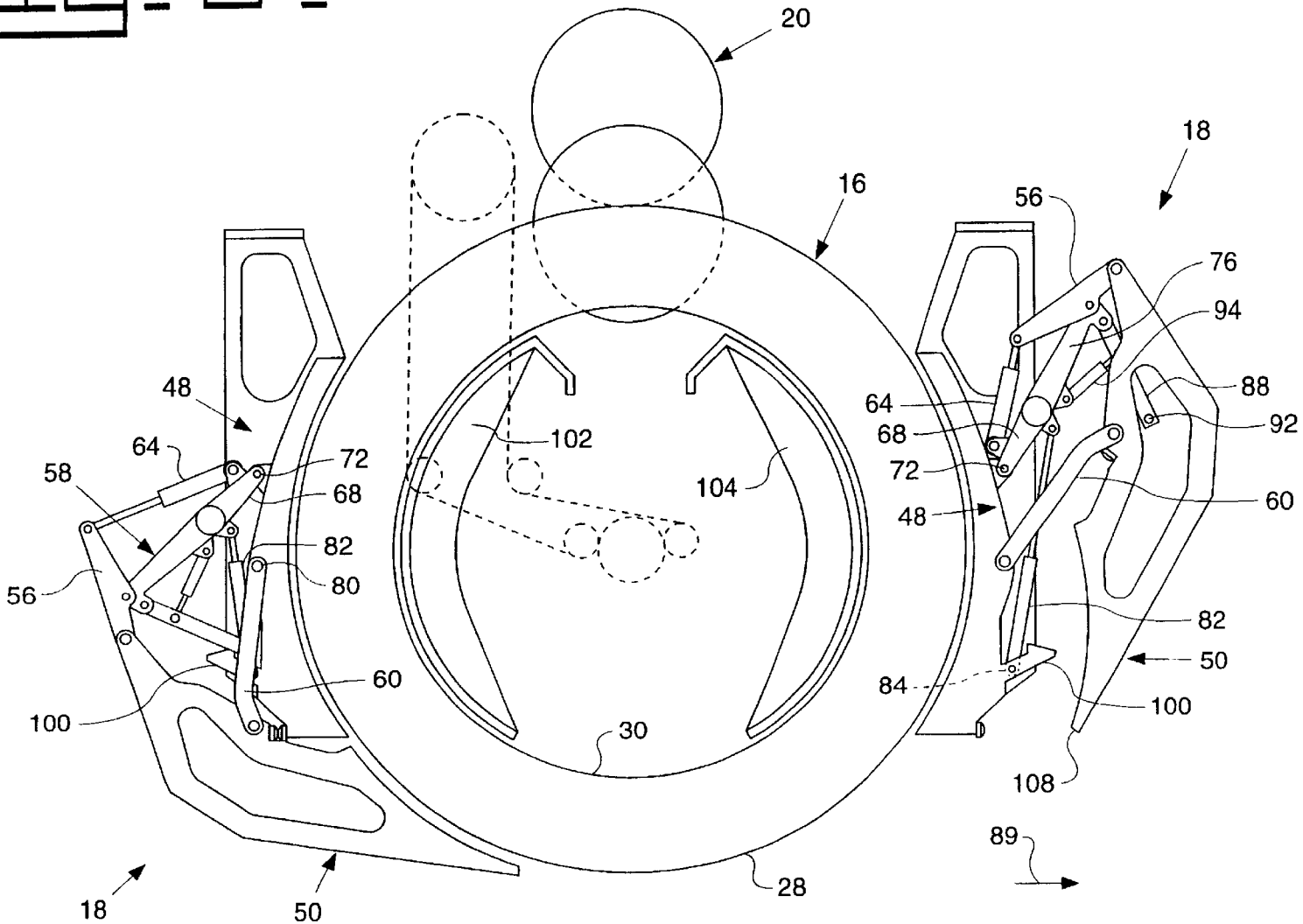
FIG. 2 is a side elevational view illustrating the present outer and inner shoe/shield mechanisms attached to a typical excavating wheel assembly, one of the shoe mechanisms being located adjacent the trailing side of the wheel assembly and the other shoe mechanism being located adjacent the leading side of the wheel assembly.
Figure 3:
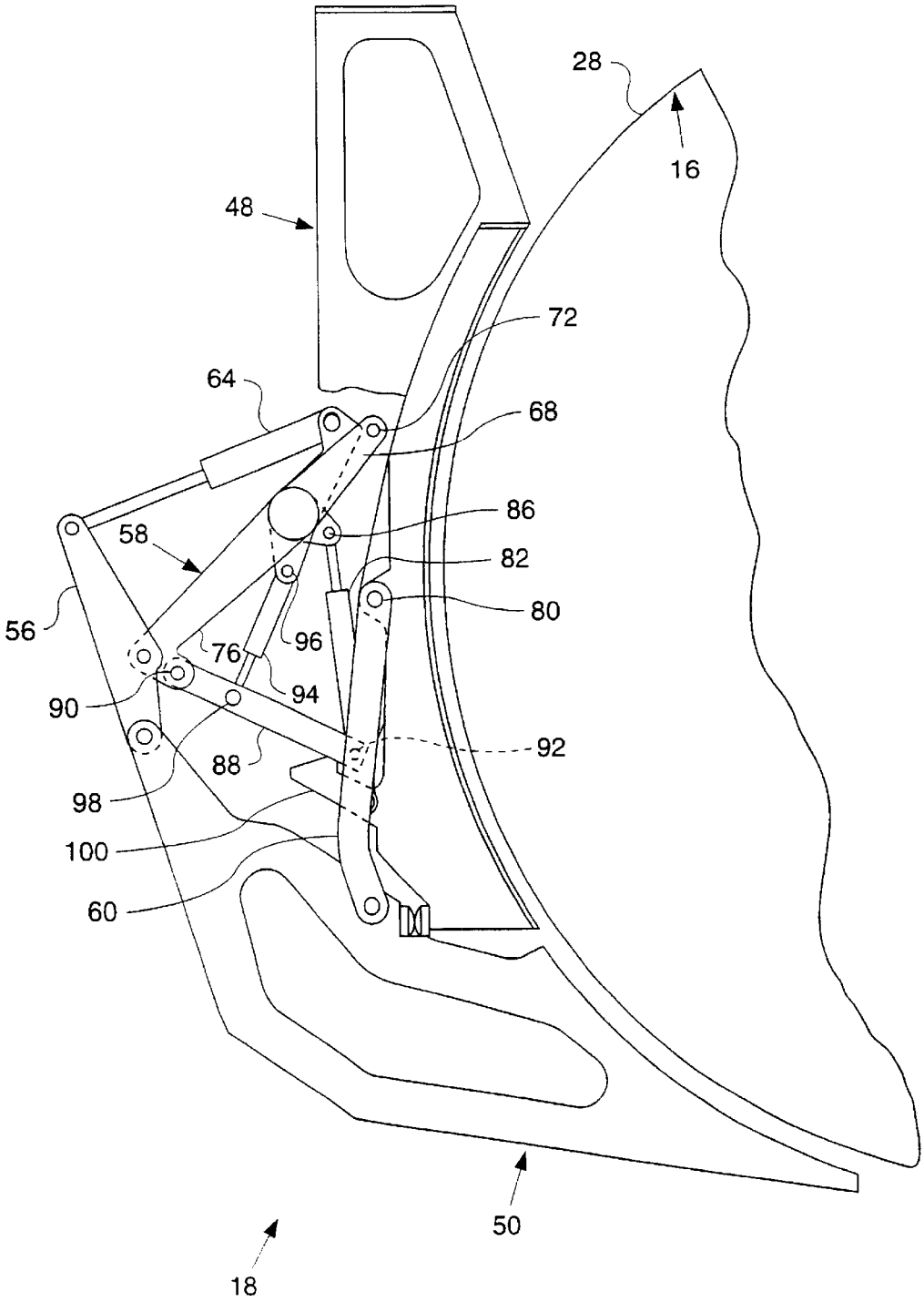
FIG. 3 is a partial side elevational view illustrating one of the present outer shoe/shield mechanisms in an operative position relative to the wheel assembly.
Figure 4:
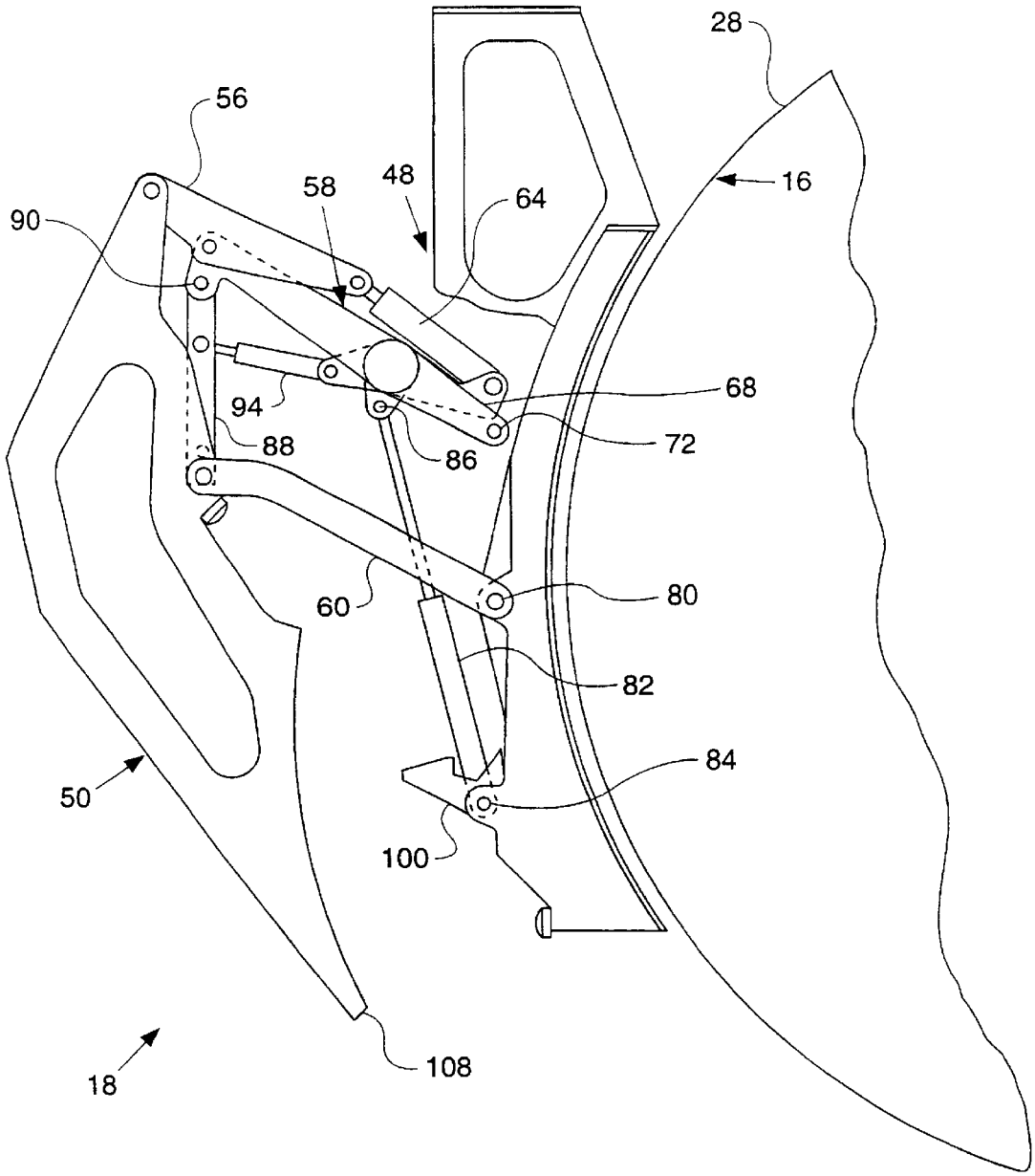
FIG. 4 is a partial side elevational view illustrating one of the present outer shoe/shield mechanisms in a retracted or inoperative position.
Figure 5:
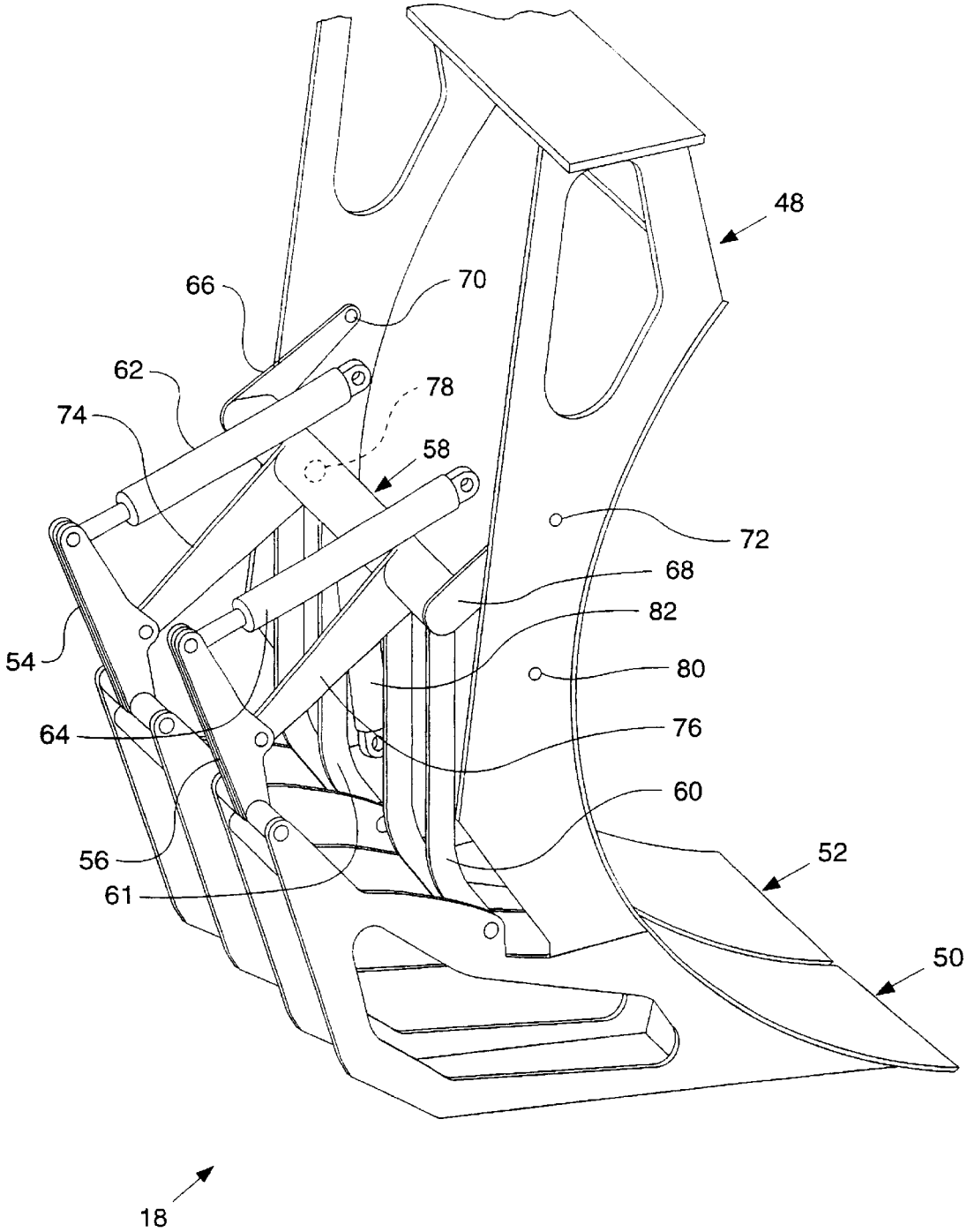
FIG. 5 is a partial prospective view illustrating some of the linkage and actuating cylinder arrangements associated with one of the present outer shoe/shield mechanisms.
Figure 6:
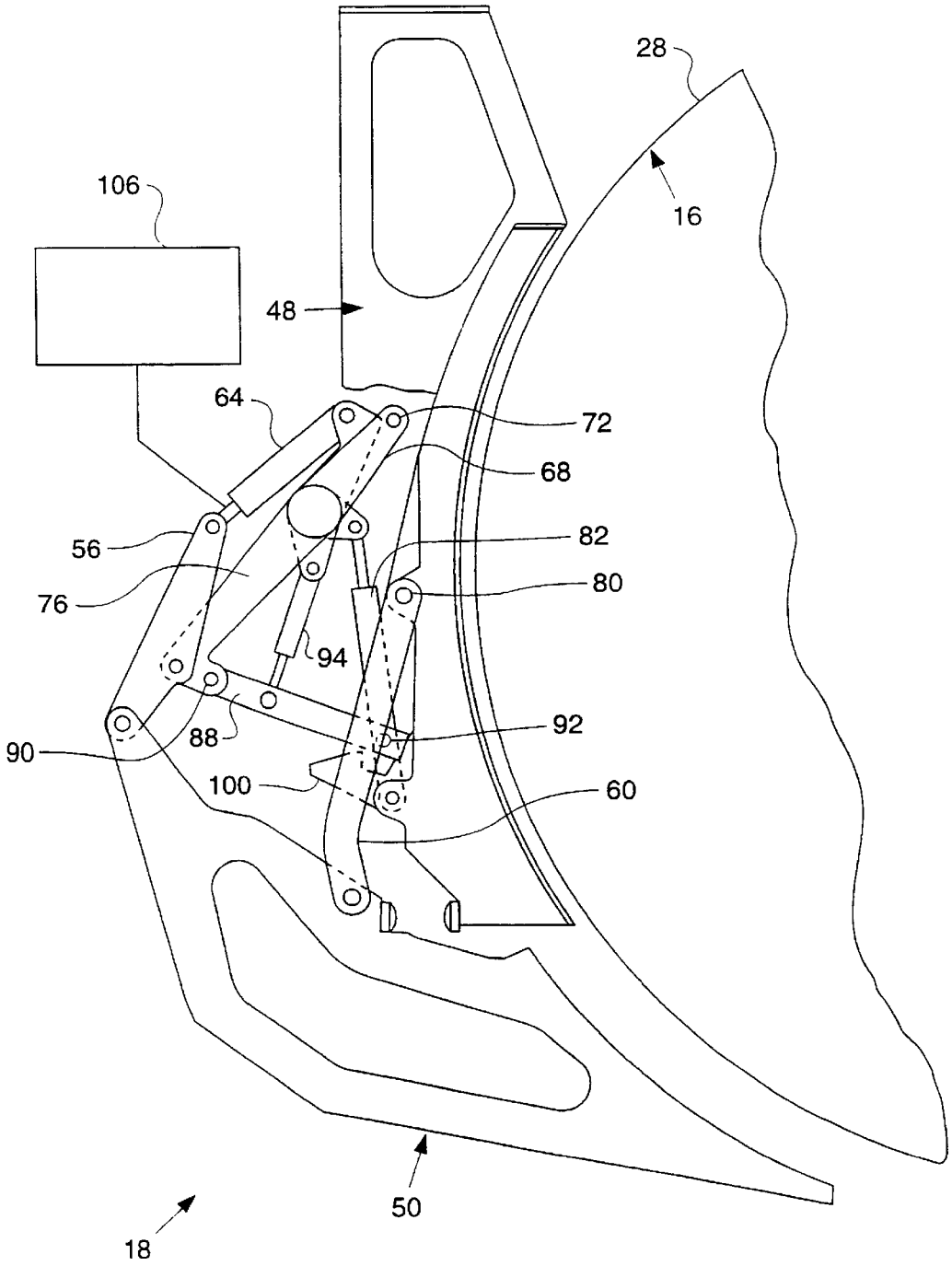
FIG. 6 is a partial side elevational view illustrating one of the present outer shoe/shield mechanisms in a tripped or recoiled position.

FIGS. 2–7 illustrate the construction of the present shoe/shield mechanisms 18, it being understood that the construction and operation of the shoe mechanism 18 associated with the trailing side of the wheel assemblies 32 and 34 will be substantially similar to the construction and operation of the shoe mechanism 18 associated with the leading side of the wheel assemblies 32 and 34. In this regard, FIG. 2 illustrates the present outer shoe/shield mechanisms 18 pivotally connected to the wheel frame portions 48, one outer shoe mechanism 18 being located adjacent the portion of the outermost circumference 28 that is on the trailing side of the respective wheel assemblies 32 and 34 and the other shoe mechanism 18 being located adjacent the portion of the outermost circumference 28 that is on the leading side of the respective wheel assemblies 32 and 34. Based upon the direction of movement of the dredging apparatus 10 as indicated by arrow 89 in FIG. 2, the trailing shoe mechanism 18 is positioned in its operative position and the leading shoe mechanism 18 is positioned in its retracted position. FIG. 3 illustrates one of the present outer shoe mechanisms 18 in an operative position relative to the wheel assemblies 32 and 34; FIG. 4 shows one of the present outer shoe mechanisms 24 in a retracted or inoperative position; FIG. 5 illustrates some of the linkage and actuating cylinder arrangement associated with each mechanism 18; FIG. 6 illustrates one of the present outer shoe mechanism 18 in a tripped or recoiled position; and FIG. 7 more clearly illustrates the latching mechanism associated with each shoe/shield mechanism 18. Each outer shoe mechanism 18 is pivotally attached to portion 48 of the wheel frame assembly at a plurality of pivot points and each has a combined width substantially equal to the width of the wheel assemblies 32 and 34.

The preferred actuating cylinder arrangement is shown using fluid actuating type cylinders, however other types of actuators, such as screw type actuators, could be utilized in any combination.

As best illustrated in FIG. 1, each outer shoe/shield mechanism 18 includes a pair of arcuate members 50 and 52, although it is recognized and anticipated that a single arcuate member could replace members 50 and 52 without departing from the spirit and scope of the present invention. Arcuate shoe/shield members 50 and 52 are pivotally connected to wheel frame portion 48 through the use of a plurality of linkage members such as the members 54, 56, 58, 60 and 61 as best illustrated in FIGS. 1 and 5. Linkage members 54 and 56 are pivotally attached to the respective arcuate shoe members 50 and 52 at one end portion thereof in a conventional manner, the opposite end portion of linkage members 54 and 56 being respectively pivotally attached to one end portion of a pair of actuating cylinders 62 and 64 as best illustrated in FIGS. 1 and 5. The opposite end portions of the actuating cylinders 62 and 64 are pivotally attached to linkage member 58 as illustrated in FIGS. 2–5. Since FIGS. 2–4 are side elevational views only, only one of the pair of arcuate shoe members 50 and 52 is illustrated therein. It is recognized that the construction and operation of the shoe member not shown in FIGS. 2–4 is substantially identical to the construction and operation of the particular shoe member illustrated therein.

Linkage or lever member 58 includes a pair of arm portions 66 and 68 which are pivotally connected to frame portion 48 at pivot points 70 and 72, and a pair of arm portions 74 and 76 which are likewise pivotally connected to linkage members 54 and 56 at an intermediate location therealong as best illustrated in FIGS. 3–5. In similar fashion, linkage members 60 and 61 (FIG. 5) are pivotally connected at one end portion to frame portion 48 at pivot points 78 and 80, their opposite end portions being respectively pivotally attached to the shoe members 50 and 52 in a conventional manner as illustrated in FIGS. 2–7. An actuating cylinder 82 is pivotally connected at one end portion thereof to frame portion 48 at pivot point 84 (FIG. 4) and its opposite end portion is pivotally attached to linkage member 58 at pivot point 86. The actuating cylinders 62, 64 and 82 are used to control the pivotal movement of the shoe/shield mechanism 18 in both the horizontal and vertical direction away from the wheel assemblies 32 and 34 as will be hereinafter explained.

As best illustrated in FIGS. 3–5, actuating cylinder 82 controls the vertical movement of the shoe/shield mechanism 18 whereas actuating cylinders 62 and 64 control the in and out horizontal movement of the shoe mechanism 18 relative to the wheel assemblies 32 and 34. As a result, coordinated actuation of the respective cylinders 62, 64 and 82 will position and locate the shoe/shield mechanisms 18 in their operative positions adjacent the wheel assemblies 32 and 34 as illustrated to the left of the wheel assemblies illustrated in FIGS. 1 and 2 and as illustrated in FIG. 3. Actuating cylinders 62, 64 and 82 also function to pivotally move the shoe/shield mechanisms 18 from their operative positions to their retracted or inoperative positions as illustrated to the right of the wheel assemblies illustrated in FIGS. 1 and 2 and as illustrated in FIG. 4. The present shoe mechanisms 18 are therefore pivotally movable between their respective operative and retracted positions depending upon the direction of movement of the apparatus 10 and the direction of rotation of the wheel assemblies 32 and 34.

Figure 7:
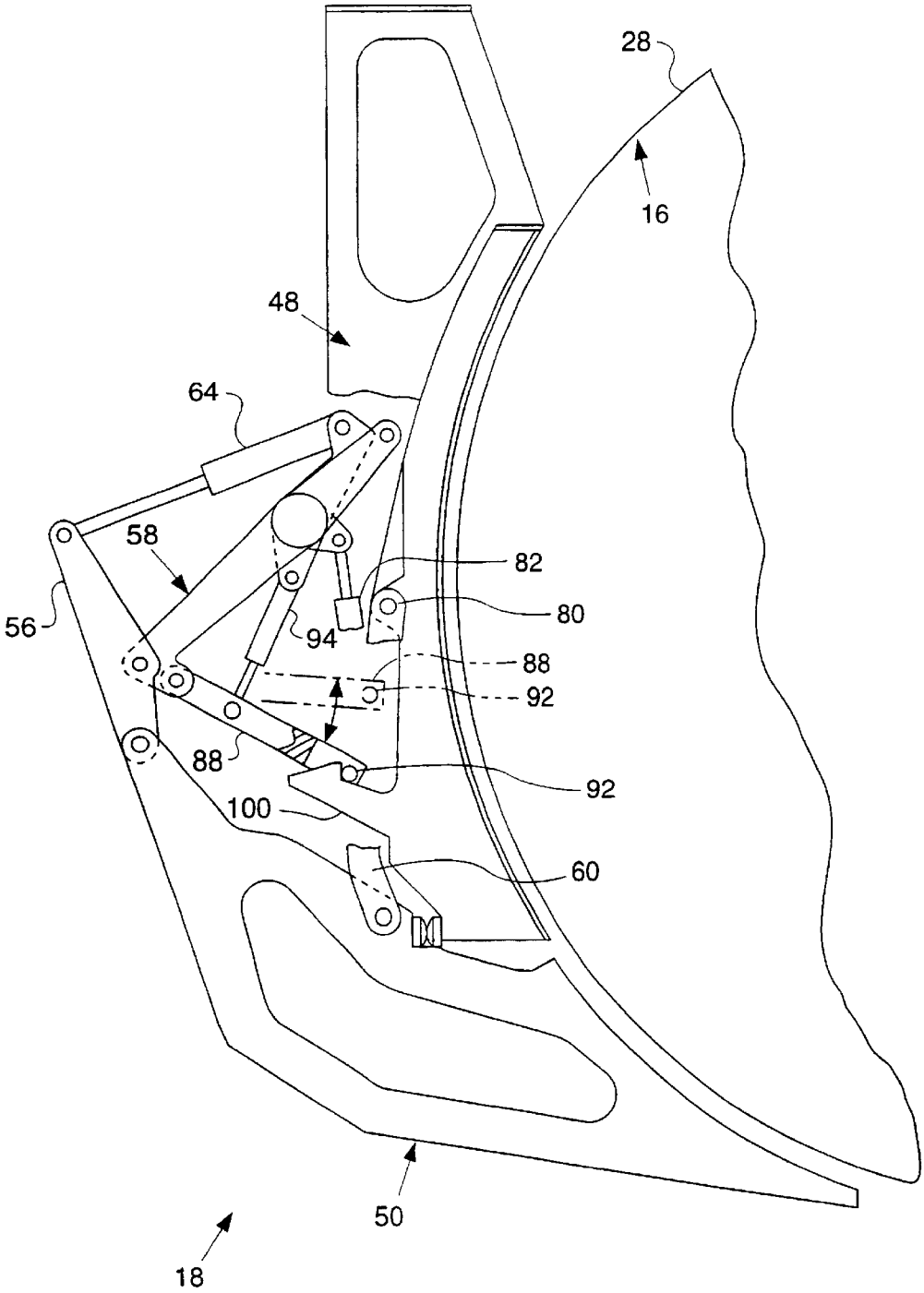
FIG. 7 is a partial side elevational view illustrating the latching mechanism associated with each of the present outer shoe/shield mechanisms.

Each shoe/shield mechanism 18 likewise includes a latching mechanism associated with each respective shoe member such as the shoe member 50 illustrated in FIGS. 3, 4 and 7. The latch mechanism includes a linkage member 88, an actuator 94, and a hook member 100. The linkage member 88 has one end portion pivotally connected to arm portion 76 of linkage or lever member 58 at pivot point 90 and its opposite end portion includes a pin member 92 adaptable for engaging the hook member 100 which is associated with frame portion 48. The actuator 94 is used for latching and unlatching pin member 92 with respect to hook member 100, the actuator 94 having one end portion pivotally connected to linkage or lever member 58 at pivot point 96 and having its opposite end portion pivotally connected to linkage member 88 at an intermediate location 98 therealong as best illustrated in FIGS. 3, 4 and 7. Actuator 94 likewise operates in conjunction with actuating cylinders 62, 64 and 82 to pivotally move the respective shoe/shield mechanisms 18 into an out of their respective operative positions.

As best illustrated in FIGS. 3 and 7, when shoe member 50 is positioned in its operating position adjacent the outer circumference 28 of wheel assemblies 32 and 34, actuator 94 will control the movement of linkage member 88 so as to position the pin member 92 into engagement with hook member 100. As shoe member 50 approaches its operative position, actuator 94 will extend, either partially or fully, so as to move pin member 92 into locking engagement with hook member 100 as best illustrated in FIG. 7. When in its latched condition, movement of actuating cylinder 82 will not effect movement of shoe member 50 or shoe mechanism 18 out of its operating position. Since actuator 94 will be exerting a force against linkage member 88 holding pin member 92 in locking engagement with hook member 100, any movement or extension of actuating cylinder 82 in an effort to pivotally rotate linkage member 58 in an upward direction to move shoe member 50 out of its operative position will merely cause pin member 92 to move against hook member 100. As a result, the present latching mechanism functions to hold the shoe mechanism 18 in its operative position. Before shoe member 50, or shoe/shield mechanism 18, can be pivotally moved out of its operative position, actuator 94 must first be retracted to move pin member 92 out of engagement with hook member 100. Once pin member 92 clears hook member 100, actuating cylinder 82 in conjunction with actuating cylinders 62 and 64 can thereafter pivotally rotate the entire mechanism 18 to its fully retracted position as illustrated in FIG. 4. Here again, actuator 94 will operate in conjunction with actuating cylinder 62, 64 and 82 in order to latch and unlatch pin member 92.

Operation and control of the respective cylinders 62, 64, 82 and 94 can be manually controlled and operated via the operator of the dredging apparatus 10, or such cylinders can be automatically controlled through the use of an onboard electronic control system. In this regard, appropriate switches and/or sensors would be associated with each of the actuating cylinders and/or their associated linkage embers and such switches and/or sensors would provide input signals to an electronic controller indicative of the operating position or condition of such cylinders and/or linkage members. Based upon such input signals, an appropriate electronic controller would output appropriate signals to the respective cylinders 62, 64, 82 and 94 to control the extension and retraction thereof. Other automated control systems can likewise be utilized to accomplish this task.

In the specific configuration illustrated in FIG. 2, the dredging apparatus 10 would be moving in the direction of arrow 89 and the wheel assemblies 32 and 34 would be rotating in a clockwise direction. As the wheel assemblies 32 and 34 rotate, the respective silt retaining chambers 40 move through the body of water at a depth sufficient to effectively fill each such chamber with silt. As the silt retaining chambers 40 continue to move through the body of water, the outer arcuate shoe mechanism 18 on the trailing side of the wheel assemblies 32 and 34 shoe the silt from the water and hold the silt in the respective chambers.

In this regard, a pair of inner arcuate shoe/shield members 102 and 104 are likewise connected to the wheel frame assembly 24 and are disposed along a portion of the respective wheel assemblies 32 and 34 adjacent the innermost circumference 30. Depending upon the direction of rotation of the wheel assemblies 32 and 34, one of the inner arcuate shoe members 102 or 104 will extend adjacent the innermost circumference 30 of each wheel assembly at a location near the bottom portion of the wheel assemblies 32 and 34 adjacent the silt retaining chambers 40 that are filled with silt to a point just prior to ejection of the silt near the top portion of the wheel assemblies, while the other inner arcuate shoe member 102 or 104 will extend along a portion of the innermost circumference 30 subsequent to the ejection of the silt to a point generally at which the silt retaining chambers 40 reenter the body of water. As a result, one inner arcuate member 102 or 104 helps to retain the silt within the silt retaining chambers 40 until just prior to ejection thereof, whereas the other inner arcuate shoe member 102 or 104 will prevent any silt remaining in the respective chambers 40 after ejection thereof from exiting prior to such chambers reentering the body of water. As illustrated in FIGS. 1 and 2, when one outer arcuate shoe mechanism 18 is positioned in its operative position, the other outer arcuate shoe mechanism 18 is positioned in its retracted position so as not to interfere with the dredging operation in a particular direction.

A release or recoil mechanism is likewise associated with each outer shoe mechanism 18 so as to permit the respective arcuate shoe members 50 and 52 to pivot away from the wheel assemblies 32 and 34 and stop the rotation of such wheel assemblies in the event an object becomes wedged between the wheel assemblies and the arcuate members 50 and 52. The present release mechanism includes linkage members 54 and 56 as well as fluid actuating cylinders 62 and 64. When the present shoe mechanism 18 is positioned and latched in its operative position as indicated in FIG. 3, the latching engagement of pin 92 with hook member 100 prevents linkage members 58 and 88 from pivotally moving due to any force exerted against shoe members 50 and/or 52 as a result of a foreign objected being wedged between the wheel assemblies and any one of the respective shoe members. In this event, the force exerted against shoe member 50 due to an object wedged between the wheel assemblies and the shoe members will be transferred therethrough to the linkage member 56. This force will likewise be transferred to the actuating cylinder 64 through linkage member 56. If the exerted force applied against actuating cylinder 64 exceeds or overcomes the biasing force created by such cylinder, cylinder 64 will begin to retract or recoil thereby allowing the shoe member 50 to pivot away from the wheel assemblies 30 and 32 as illustrated in FIG. 6. This recoiling effect can be controlled and varied depending upon the cylinder pressure established for actuating cylinders 62 and 64 when the respective shoe/shield mechanisms 18 are positioned and held in their respective operative positions.

A switch, sensor or other signal generating means 106 can be operatively coupled to actuating cylinders 62 and 64 so as to provide a signal to stop the rotation of the wheel assemblies 32 and 34 whenever the biasing force exerted by such cylinders is exceeded while the shoe mechanism 18 is in its operative and latched condition. This combination of events would indicate that a foreign object is exerting a force against the recoil cylinders 62 and/or 64 sufficient to move shoe member 50 and/or 52 away from the excavating wheel assemblies while the respective shoe members are still latched and in their operative position. After sensing this particular combination of events, signal generating means 106 would output an appropriate signal or signals to an appropriate control means to stop the rotation of wheel assemblies 32 and 34. It is recognized and anticipated that other logic sequences as well as other switch and sensor arrangements could be utilized to output an appropriate signal to stop the rotation of the respective wheel assemblies. It is also recognized that the wheel assemblies may also be manually stopped by the operator after receiving a signal from signal generating means 106 or some other warning system. Once the foreign object has been removed, actuating cylinders 62 and 64 are reset in that no recoil forces are being exerted thereagainst, and no signal is being outputted by signal generating means 106 to stop the rotation of wheel assemblies 32 and 34, the excavating wheel assemblies being once again operational to continue a dredging operation.

Industrial Applicability

The present shoe/shield mechanisms 18 are adaptable for use with a wide variety of different types of dredging apparatus wherein one or more silt excavating wheel assemblies are utilized to remove silt or other sediment from under a body of water. When a pair of the present outer shoe/shield mechanisms 18 are pivotally connected to the excavating wheel frame assembly 24 adjacent both the leading and trailing side of the wheel assemblies as illustrated in FIGS. 1 and 2, and when the pair of inner arcuate shoe members 90 and 92 are likewise positioned as illustrated in FIG. 2, the dredging apparatus 10 will be capable of performing a dredging operation in both the forward and reverse directions of travel.

Use of the present shoe/shield mechanisms 18 during a dredging operation is as follows. Prior to removing silt from a body of water, the depth of water above the silt bed is determined and charted. If the dredging apparatus 10 is being operated in cooperation with a global positioning system (GPS), the charted information is entered into the apparatus control system and set with respect to the fixed remote location. During use, the respective drive wheels associated with apparatus 10 are lowered into the water until the spades thereof engage the silt, and the silt excavating wheel mechanism 16 is thereafter lowered into the water to a depth equivalent to the depth necessary for the silt retaining chambers 40 to effectively fill with silt. Depending upon the direction of travel of the dredging apparatus 10, one shoe/shield mechanism 18 will be pivotally positioned to its operative position, and the other shoe/shield mechanism will be pivotally moved to its retracted or inoperative position. For example, as best illustrated in FIG. 2, if the dredging apparatus 10 is moving in a direction of travel corresponding to the direction of arrow 89, the shoe mechanism 18 located on the trailing side (left hand side of FIG. 2) of excavating wheel assemblies 32 and 34 will be moved to its operative position adjacent the outermost wheel circumference 28, and the shoe/shield mechanism 16 located on the leading side (right side of FIG. 2) of the wheel assemblies will be moved to its retracted or inoperative position away from the wheel assemblies.

With the dredging apparatus 10 moving in the direction of arrow 89, the wheel assemblies 32 and 34 will be rotating in a clockwise direction. As the silt excavating wheel assemblies rotate, the respective silt retaining chambers 40 move through the body of water towards the topmost position of the respective wheel assemblies. As the chambers 40 move through the water, the outer arcuate shoe/shield assemblies 50 and 52 shoe the silt in the respective silt retaining chambers 40 from the water. Consequently, the silt does not carry large amounts of water along with it. Likewise, the water does not have a tendency to wash the silt from the chambers 40. As the wheel assemblies 32 and 34 continue to rotate and carry the silt from the bottom towards the top of the wheel assemblies, the inner arcuate shoe/shield member 102 functions to shoe the silt from the water and likewise retains the silt in the respective silt retaining chambers 40 prior to the chambers 40 reaching the topmost portion of the wheel assemblies. once the silt retaining chambers 40 reach the topmost position of the respective wheel assemblies 32 and 34, the silt is in position to be removed from the chambers 40 and deposited onto a conveyor system or other means for transporting the silt to an appropriate storage area. Prior to the respective chambers 40 reaching the topmost position of the respective wheel assemblies, the inner arcuate shoe/shield member 102 is terminated to allow the silt to exit the respective chambers 40. As the silt retaining chambers 40 reach the topmost position, an appropriate ejector member is forced downward into the topmost chamber 40 to eject the silt from such chamber. An appropriate timing device in conjunction with the turning of the respective wheel assemblies 32 and 34 will move the appropriate ejector member downward into the topmost silt retaining chamber 40. As the wheel assemblies continue to rotate, the inner arcuate shoe/shield member 104 functions to shoe or close the respective chambers 40 as they again move downward towards the body of water. In the event that all of the silt did not fall from the respective topmost chambers 40, the inner shoe/shield member 104 will prohibit any remaining silt from falling out of the chambers 40 and into the water. Any silt falling back into the water tends to agitate the water and causes undo mixing of the water and silt at the bottom of the body of water thereby reducing the overall effectiveness of the dredging operation.

In the event that a foreign object becomes wedged between one or both of the wheel assemblies 32 and 34 and the operative outer arcuate shoe mechanism 18 during a silt removing process, the release or recoil mechanism illustrated in FIG. 6 will trip and the wheel assemblies 32 and 34 will stop rotation. In this regard, the wheel assemblies may be stopped by the operator after receiving a signal from a switch or from signal generating means 106, or the wheel assemblies may be automatically stopped via signal generating means 106 and other appropriate control systems. Once the foreign object has been removed, the release mechanism is reset and the apparatus is ready to continue the dredging operation.

Since the dredging configuration illustrated in FIG. 2 has the respective wheel assemblies 32 and 34 rotating in a clockwise direction, the retracted outer arcuate shoe/shield mechanism 18 located on the leading side of the wheel assemblies is positioned so as not to interfere with the rotation of the respective wheel assemblies, nor does it interfere with the silt retaining chambers 40 entering the body of water. In this regard, the strength or consistency of the silt or sediment to be removed normally varies as a function of depth, the upper portion or upper level of the silt or sediment having a very fine consistency or low strength which is unacceptable or not desirable for removal during a dredging operation. Since the strength or consistency of this upper portion or upper level of the silt or sediment being removed from the body of water is typically unacceptable to dredge, the bottom edge portion 108 of the outer shoe mechanism 18 positioned in its retracted position in front of the excavator wheel assemblies 32 and 34 can be positioned at the appropriate depth or at the dividing line between acceptable and unacceptable silt consistency such that the bottom edge portion 108 of the forward outer shoe mechanism 18 can be used to bulldoze the unacceptable sediment layer away from the path of the silt excavating wheel assemblies 32 and 34. This positioning of the forward shoe mechanism 18 would further improve the efficiency of the overall dredging operation since the wheel assemblies 32 and 34 can be appropriately positioned depthwise so that the silt removing chambers 40 will completely fill with silt having an acceptable dredging consistency or strength.

The positioning of the bottom edge portion 108 of the retracted outer shoe mechanism 18 can be manually controlled by an operator, or such positioning can again be automatically controlled by the control system associated with the dredging apparatus 10. Such automatic control may include programming the depth of water above the silt bed into the control system of apparatus 10 and thereafter providing such control system with a signal indicative of the depth of acceptable silt consistency or strength. The control system would likewise be coupled to appropriate actuating systems for moving the actuating cylinders 62, 64, 82 and 94 associated with each outer shoe/shield mechanism 18 such that the position of the bottom edge portion 108 of the retracted outer shoe mechanism 18 can be controlled and positioned in response to the signal received indicative of the acceptable silt depth. An appropriate control system can likewise be linked and coupled to a GPS system as illustrated in U.S. Pat. No. 5,960,570. Other automatic control configurations are likewise recognized and anticipated.

In the event that the dredging apparatus 10 illustrated in FIG. 2 reverses its direction of travel as compared to the direction of movement indicated by arrow 89, the positioning of the respective outer arcuate shoe/shield mechanisms 18 can likewise be reversed and a dredging operation can again be preformed in the opposite direction. In this particular situation, both the drive wheel assemblies as well as the silt excavating wheel assemblies 32 and 34 will be rotated in a counterclockwise direction. In all other respects, the operation of the dredging apparatus 10 as well as the operation and function of the respective outer shoe/shield mechanisms 18 will be substantially the same as previously described.

In view of the foregoing, it is readily apparent that the use of a pair of the present shoe/shield mechanisms 18 is an effective mechanism to not only prohibit large amounts of water from mixing with the silt as the silt is being removed by the overall apparatus 10, but such mechanisms enable the dredging apparatus to operate in both a forward and a reverse direction of travel. This eliminates unnecessary maneuvering of the dredging apparatus 10 when reversing the direction of the dredging operation in a particular body of water; it advantageously speeds up the process of removing silt from the bottom of the body of water; and it improves the overall efficiency and effectiveness of the dredging operation. The present shoe mechanisms 18 and their associated latch and release mechanisms likewise effectively operate to protect the wheel assemblies 32 and 34 from damaged due to foreign object ingestion between the wheel assemblies and the outer arcuate shoe mechanisms 18 in both directions of travel.

The construction and operation of the present shoe/shield mechanism 18 is likewise advantageous for use in a conventional dredging operation where dredging occurs in one direction only such as disclosed in U.S. Pat. No. 5,960,570. In this particular situation, only one of the present shoe/shield mechanisms 18 need be operatively positioned on the trailing side of the associated wheel assemblies, the present retracting and latching mechanisms providing improved advantages over the known shoe/shield mechanisms.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the sprit and scope of the present invention.

Other aspects, objects and advantages of the present invention can be obtained from a study of the drawings, the disclosure and the appended claims.

What is claimed is:

1. A shoe mechanism adapted for use on a dredging apparatus (10) to remove silt from under the surface of a body of water, the dredging apparatus being operative in a forward and reverse direction and including an excavating wheel assembly (16), the excavating wheel assembly having an innermost (30) and an outermost (28) circumference, top and bottom portions, and a plurality of silt retaining chambers (40), the excavating wheel assembly being rotatably mounted on a wheel frame assembly (24) to define a leading side and a trailing side of the wheel assembly when the apparatus is operative in its forward or reverse direction, the shoe mechanism comprising:

a pair of outer shoe assemblies (18) pivotally connected to the wheel frame assembly (24), one of said shoe assemblies being located adjacent a portion of the excavating wheel assembly (16) on the leading side thereof and one of said shoe assemblies being located adjacent a portion of the excavating wheel assembly (16) on the trailing side thereof;

each of said outer shoe assemblies (18) being pivotally movable between an operative position wherein said shoe assembly is positioned adjacent the outermost circumference (28) of the wheel assembly between the silt under the body of water and a point above the water level, and a retracted position wherein said shoe assembly is positioned in spaced apart relationship from the outermost circumference (28) of the wheel assembly;

one of said outer shoe assemblies (18) being positioned in its operative position and the other of said outer shoe assemblies (18) being positioned in its retracted position when the dredging apparatus is removing silt from under the surface of a body of water.

2. The shoe mechanism as set forth in claim 1 wherein, based upon the direction of travel of the dredging apparatus, said one shoe assembly (18) positioned in its operative position is disposed on the trailing side of the excavating wheel assembly (16) and the other shoe assembly (18) positioned in its retracted position is disposed on the leading side of the excavating wheel assembly (16).

3. The shoe mechanism as set forth in claim 1 including a linkage arrangement (54,56,60,61) and at least one actuating cylinder (62,64,82,94) coupled between the wheel frame assembly (24) and each of said outer shoe assemblies (18) for pivotally moving each of said outer shoe assemblies between their respective operative and retracted positions.

4. The shoe mechanism as set forth in claim 1 wherein the silt to be removed from under the surface of a body of water includes an upper portion having a consistency unacceptable for dredging, the bottom edge portion (108) of the retracted shoe assembly (18) being positionable to bulldoze the unacceptable silt away from the path of the excavating wheel assembly (16) as the dredging apparatus (10) moves through the body of water.

5. The shoe mechanism as set forth in claim 1 including a pair of inner shoe assemblies (102,104) connected to the wheel frame assembly, one of said inner shoe assemblies (104) being located adjacent the innermost circumference (30) of the wheel assembly on the leading side thereof and one of said inner shoe assemblies (102) being located adjacent the innermost circumference (30) of the wheel assembly on the trailing side thereof.

6. The shoe mechanism as set forth in claim 5 wherein each of said inner shoe assemblies (102,104) extend adjacent the innermost circumference (30) of the excavating wheel assembly (16) from a point just prior to the bottom portion of the wheel assembly to a point just prior to the top portion of the wheel assembly.

7. The shoe mechanism as set forth in claim 1 including a release mechanism (54,56,62,64) connected to each of said outer shoe assemblies (18) operative to permit the respective outer shoe assemblies to pivot away from the excavating wheel assembly (16) in the event that a foreign object becomes trapped between the excavating wheel assembly (16) and said outer shoe assemblies (18).

8. The shoe mechanism as set forth in claim 7 wherein movement of said release mechanisms (54,56,62,64) when the outer shoe assemblies (18) are positioned in their operative position delivers a signal (106) to stop the rotation of the excavating wheel assembly (16).

9. The shoe mechanism as set forth in claim 1 including a latching mechanism (88,94,100) associated with each of said outer shoe assemblies (18), each latching mechanism including a hook member (100) connected to the wheel frame assembly (24) and at least one linkage member (88) pivotally coupled to each of said outer shoe assemblies, said at least one linkage member having means (92) associated therewith for cooperatively engaging said hook member (100) when each of said outer shoe assemblies are positioned in their operative position.

10. The shoe mechanism as set forth in claim 9 wherein said means associated with said at least one linkage member (88) includes a pin member (92) and an actuator (94), said pin member (92) being connected adjacent one end portion of said at least one linkage member (88) and said actuator (94) being pivotally connected to said at least one linkage member.

11. The shoe mechanism as set forth in claim 10 wherein said actuator (94) is a fluid actuating cylinder.

12. The shoe mechanism as set forth in claim 10 wherein said actuator (94) is a screw type actuator.

13. The shoe mechanism as set forth in claim 1 wherein said excavating wheel assembly (16) is rotatably operative in both a clockwise and counterclockwise direction depending upon the direction of travel of the dredging apparatus.

14. A shoe mechanism adapted for use on a dredging apparatus (10) to remove silt from under the surface of a body of water, the dredging apparatus including an excavating wheel assembly (16) having an innermost (30) and an outermost (28) circumference and a plurality of silt retaining chambers (40), the excavating wheel assembly being rotatably mounted on a wheel frame assembly (24) to define a trailing side of the excavating wheel assembly, the shoe mechanism comprising:

an outer shoe assembly (18) pivotally connected to the wheel frame assembly (24) adjacent a portion of the excavating wheel assembly (16) on the trailing side thereof;

said outer shoe assembly (18) being pivotally moveable between an operative position wherein said shoe assembly (18) is positioned adjacent the outermost circumference (28) of the wheel assembly between the silt under the body of water and a point above the water level, and a retracted position wherein said shoe assembly (18) is positioned in spaced apart relationship from the outermost circumference (28) of the wheel assembly; and a latching mechanism (88,94,100) associated with said outer shoe assembly (18), said latching mechanism including a hook member (100) associated with the wheel frame assembly (24), at least one linkage member (88) pivotally coupled to said outer shoe assembly (18), and an actuator (94) pivotally connected to said at least one linkage member, said at least one linkage member (88) having a pin member (92) associated therewith engageable with said hook member, said actuator (94) being actuatable to engage and disengage said Din member (92) with said hook member (100) when said outer shoe assembly (18) is positioned in its operative position.

15. The shoe mechanism as set forth in claim 14 including a release mechanism (54,56,62,64) connected to said outer shoe assembly (18) operable to permit said shoe assembly to pivot away from the excavating wheel assembly (16) in the event a foreign object becomes trapped between the excavating wheel assembly (16) and said outer shoe assembly.

16. The shoe mechanism as set forth in claim 15 wherein said release mechanism includes a linkage member (54,56) pivotally connected to said outer shoe assembly (18) and biased to a position to releasably set said linkage member (54,56) in a first position when said outer shoe assembly is positioned in its operative position.

17. The shoe mechanism as set forth in claim 16 wherein the linkage member (54,56) associated with said release mechanism is biased to said first position by a fluid actuating cylinder (62,64).

18. The shoe mechanism as set forth in claim 17 wherein movement of said linkage member (54,56) from said first position delivers a signal (106) to stop the rotation of the excavating wheel assembly.

19. The shoe mechanism as set forth in claim 18 wherein said pin member (92) remains engaged with said hook member (100) when the linkage member (54,56) associated with the said release mechanism is moved from said first position.

20. The shoe mechanism as set forth in claim 14 wherein said actuator (94) is a fluid actuating cylinder.

21. The shoe mechanism as set forth in claim 14 wherein said actuator (94) is a screw type actuator.

22. A method for removing silt from under the surface of a body of water using a dredging apparatus (10) operative in both a forward and reverse direction, the dredging apparatus including an excavating wheel assembly (16) having an innermost (30) and an outermost (28) circumference and a plurality of silt retaining chambers (40), the excavating wheel assembly being rotatably mounted on a wheel frame assembly (24) to define a leading side and a trailing side of the wheel assembly when the apparatus is operative in its forward or reverse direction, the method comprising the following steps:

attaching a pair of outer shoe assemblies (18) to the wheel frame assembly (24), one of said shoe assemblies being located adjacent a portion of the excavating wheel assembly on the leading side thereof and one of said shoe assemblies being located adjacent a portion of the excavating wheel assembly on the trailing side thereof;

enabling each of said outer shoe assemblies (18) to be pivotally movable relative to the wheel assembly (16), each of said outer shoe assemblies being pivotally movable between an operative position wherein said shoe assembly is positioned adjacent the outermost circumference (28) of the wheel assembly (16) between the silt under the body water and a point above the water level, and a retracted position wherein said shoe assembly is positioned in spaced apart relationship from the outermost circumference (28) of the wheel assembly (16);

determining the direction of travel (89) of the dredging apparatus (10) for a particular dredging operation;

determining the leading side and trailing side of the wheel assembly (16) based upon the direction of travel (89) of the dredging apparatus for the particular dredging operation;

positioning the shoe assembly (18) disposed on the trailing side of the excavating wheel assembly (16) in its operative position prior to commencing the particular dredging operation; and positioning the shoe assembly (18) disposed on the leading side of the excavating wheel assembly (16) in its retracted position prior to commencing the particular dredging operation.

23. The method as set forth in claim 22 wherein the silt to be removed from under the surface of a body of water includes an upper portion having a consistency unacceptable for dredging, said method further including the step of positioning the bottom edge portion (108) of the retracted shoe assembly (18) at an appropriate position under the surface of the body of water such that the bottom edge portion (108) of the retracted shoe assembly will bulldoze the unacceptable silt away from the path of the excavating wheel assembly (16) as the dredging apparatus (10) moves through the body of water.

24. The method as set forth in claim 22 including the following step:

attaching a pair of inner shoe assemblies (102,104) to the wheel frame assembly (24), one of said inner shoe assemblies (104) being located adjacent the innermost circumference (30) of the wheel assembly (16) on the leading side thereof and extending from a point just prior to the bottom portion of the wheel assembly to a point just prior to the top portion of the wheel assembly, and one of said inner shoe assemblies (102) being located adjacent the innermost circumference (30) of the wheel assembly (16) on the trailing side thereof and extending from a point just prior to the bottom portion of the wheel assembly to a point just prior to the top portion of the wheel assembly.

25. The method as set forth in claim 22 including the following step:

providing a release mechanism (54,56,62,64) connected to each of said outer shoe assemblies (18) operative to permit the respective outer shoe assemblies to pivot away from the excavating wheel assembly (16) in the event that a foreign object becomes trapped between the excavating wheel assembly (16) and said outer shoe assemblies (18).

26. The method as set forth in claim 25 including the following step:

providing a mechanism (106) for detecting the movement of said release mechanisms when said outer shoe assemblies (18) are positioned in their operative positions, movement of said release mechanisms delivering a signal (106) to stop the rotation of the excavating wheel assembly.

27. The method as set forth in claim 22 including the following step:

providing a latching mechanism (88,94,100) associated with each of said outer shoe assemblies (18) for holding said outer shoe assemblies in their operative position.

28. The method as set forth in claim 27 wherein each latching mechanism includes a hook member (100) connected to the wheel frame assembly (24) and at least one linkage member (88) pivotally coupled to each of said outer shoe assemblies (18), said at least one linkage member (88) having a pin member (92) associated therewith for cooperatively engaging said hook member (100) when each of said outer shoe assemblies are positioned in their operative position.

* * * * *

UNITED STATES PATENT AND TRADEMARK OFFICE

CERTIFICATE OF CORRECTION

PATENT NO. : 6,467,200 B1
DATED : October 22, 2002
INVENTOR(S) : Ronald L. Satzler It is certified that error appears in the above-identified patent and that said Letters Patent is hereby corrected as shown below:

Column 13,
Line 47, remove "Din" and replace with -- pin --.

Signed and Sealed this

Fourth Day of February, 2003

JAMES E. ROGAN
*Director of the United States Patent and Trademark Office*